US008332217B2

(12) United States Patent
Hargreaves et al.

(10) Patent No.: US 8,332,217 B2
(45) Date of Patent: Dec. 11, 2012

(54) FAST SPECTRAL PARTITIONING FOR EFFICIENT ENCODING

(75) Inventors: David Hargreaves, Cambridge (GB); Esfandiar Zavarehei, Cambridge (GB)

(73) Assignee: Cambridge Silicon Radio Limited, Cambridge (GB)

( * ) Notice: Subject to any disclaimer, the term of this patent is extended or adjusted under 35 U.S.C. 154(b) by 248 days.

(21) Appl. No.: 12/679,724

(22) PCT Filed: Sep. 9, 2008

(86) PCT No.: PCT/GB2008/050803

§ 371 (c)(1), (2), (4) Date: Mar. 24, 2010

(87) PCT Pub. No.: WO2009/056866

PCT Pub. Date: May 7, 2009

(65) Prior Publication Data

US 2010/0202558 A1 Aug. 12, 2010

(30) Foreign Application Priority Data

Oct. 30, 2007 (GB) ..... 0721257.4

(51) Int. Cl.
*G10L 19/00* (2006.01)
*G10L 19/14* (2006.01)
*G10L 19/02* (2006.01)

(52) U.S. Cl. ..... 704/229; 704/230; 704/205; 704/201

(58) Field of Classification Search ..... 704/200, 704/200.1, 203, 204, 205, 500, 501, E19.001, 704/1, 15, 18, 22, 24, 229, 230, 201
See application file for complete search history.

(56) References Cited

U.S. PATENT DOCUMENTS

| | | | | |
|---|---|---|---|---|
| 5,481,614 | A * | 1/1996 | Johnston | 381/2 |
| 5,794,179 | A | 8/1998 | Yamabe | |
| 5,884,269 | A | 3/1999 | Cellier et al. | |
| 6,393,393 | B1 | 5/2002 | Kawahara | |
| 6,601,032 | B1 | 7/2003 | Surucu | |
| 6,725,192 | B1 | 4/2004 | Araki | |

(Continued)

FOREIGN PATENT DOCUMENTS

| | | | |
|---|---|---|---|
| EP | 0559383 | A | 9/1993 |
| JP | 2001-188563 | A1 | 7/2001 |

OTHER PUBLICATIONS

Thuong Le-Tien et al., FPGA-Based Architecture of MP3 Decoding Core for Multimedia Systems, 9 pages, Hochiminh City University of Technology, Proc. of the 9th Intl Conf on Science and Technology, Vietnam, Oct. 11-12, 2005.

*Primary Examiner* — Jesse Pullias
(74) *Attorney, Agent, or Firm* — RatnerPrestia

(57) ABSTRACT

Methods of spectral partitioning which may be implemented in an encoder are described. The methods comprise determining an estimate of bit requirements for each of a plurality of spectral sub-bands. These estimates are then used to group the sub-bands into two or more regions by minimizing a cost function. This cost function is based on the estimates of bit requirements for each sub-band and the estimates may include estimates of code bit requirements and/or additional code bit requirements for each sub-band. These estimates may be determined in many different ways and a number of methods are described.

7 Claims, 7 Drawing Sheets

U.S. PATENT DOCUMENTS 6,975,254 B1 * 12/2005 Sperschneider et al. ..... 341/107
7,277,849 B2 * 10/2007 Streich et al. ..... 704/229
7,562,021 B2 * 7/2009 Mehrotra et al. ..... 704/500
7,761,290 B2 * 7/2010 Koishida et al. ..... 704/222
2001/0053973 A1 12/2001 Tsuzuki
2004/0131204 A1 * 7/2004 Vinton ..... 381/98

* cited by examiner

FAST SPECTRAL PARTITIONING FOR EFFICIENT ENCODING

BACKGROUND

In MP3 (MPEG-1 Layer 3) encoding and decoding, the spectrum is considered to be divided into 576 frequency bins. These frequency bins are in turn grouped into sub-bands and this grouping of bins into sub-bands is defined in the MP3 specification. The sub-bands themselves are grouped into three regions which are referred to as 'Big Values', 'Count1' and 'Rzero' and the size of these regions may vary according to the particular audio signal. Big Values represents the lowest frequency lines and these are coded with the highest accuracy of all the regions. Count1 represents the higher frequency lines, which are encoded using only a small number of values and Rzero represents the highest frequencies which are removed by the encoder, and hence on decoding these frequency bins are filled with zeros.

The Big Values region is itself divided into three regions (region0, region1, region2) with each of these three regions being encoded using a particular Huffman table. This division of Big Values into three regions typically occurs for each granule when performing MP3 encoding. Some existing encoders, such as LAME (an open source MP3 encoder), use look-up tables to obtain the boundaries between these three regions according to the number of sub-bands to be encoded (e.g. the number of sub-bands within the Big Values region or the number of sub-bands which have any data in them). This requires virtually no computation but does not take into consideration the statistics of a particular audio signal which is to be encoded and therefore can result in encoding redundancies in the signal.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Methods of spectral partitioning which may be implemented in an encoder are described. The methods comprise determining an estimate of bit requirements for each of a plurality of spectral sub-bands. These estimates are then used to group the sub-bands into two or more regions by minimising a cost function. This cost function is based on the estimates of bit requirements for each sub-band and the estimates of bit requirements may include estimates of code bit requirements and/or additional code bit requirements for each sub-band. These estimates may be determined in many different ways and a number of different methods are described.

A first aspect provides a method of spectral partitioning for use in encoding a signal comprising: determining an estimate of bit requirements for each of a plurality of spectral sub-bands; and grouping the spectral sub-bands into a plurality of regions by minimising a cost function based on the estimates of bit requirements for each of the spectral sub-bands.

The estimate of bit requirements may comprise at least one of: an estimate of code bit requirements and an estimate of additional code bit requirements. The estimate of code bit requirements may comprise an estimate of bit requirements when encoded using a Huffman tree and the estimate of additional code bit requirements may comprise an estimate of bit requirements for encoding values not presented in a Huffman table.

Each spectral sub-band comprises at least one frequency bin.

The estimate of additional code bit requirements for a spectral sub-band may comprise one or more of: the number of additional code bits required to encode the maximum value in any frequency bin in the spectral sub-band and the number of frequency bins within the spectral sub-band that require additional code bits.

The estimate of code bit requirements for a spectral sub-band may comprise one or more of: the number of code bits required to encode a maximum value in any frequency bin in the spectral sub-band excluding any additional code bits and the number of frequency bins in the spectral sub-band.

The step of grouping the spectral sub-bands into regions may comprise: determining a cost function for each region for all possible combinations of spectral sub-bands; combining the cost functions for each region into a set of overall cost functions for all possible combinations of spectral sub-bands; and selecting the combination of spectral sub-bands having the lowest overall cost function.

The cost function for each region may comprise one of or a combination of: the maximum number of additional code bits required by any spectral sub-band in the region multiplied by the number of frequency bins in the region requiring additional code bits; and the maximum number of code bits required by any spectral sub-band in the region multiplied by the total number of frequency bins in the region. Where the cost function comprises a combination, this combination may comprise a sum.

The method may further comprise: selecting a code table for each of the regions; and encoding each region using the selected code table for that region.

Each code table may comprise a Huffman table.

The signal may comprise an audio signal, such as one to be encoded using an MP3 encoder.

A second aspect provides a method of spectral partitioning substantially as described with reference to FIGS. 2 to 7 of the drawings.

A third aspect provides an encoder comprising: means for determining an estimate of bit requirements for each of a plurality of spectral sub-bands; and means for grouping the spectral sub-bands into a plurality of regions by minimising a cost function based on the estimates of bit requirements for each of the spectral sub-bands.

The estimate of bit requirements may comprise at least one of: an estimate of code bit requirements and an estimate of additional code bit requirements. The estimate of code bit requirements may comprise an estimate of bit requirements when encoded using a Huffman tree and the estimate of additional code bit requirements may comprise an estimate of bit requirements for encoding values not presented in the Huffman table.

Each spectral sub-band may comprise at least one frequency bin.

The estimate of additional code bit requirements for a spectral sub-band may comprise one or more of: the number of frequency bins within the spectral sub-band that require additional code bits and the number of additional code bits required to encode the maximum value in any frequency bin in the spectral sub-band.

The estimate of code bit requirements for a spectral sub-band may comprise one or more of: the number of code bits required to encode a maximum value in any frequency bin in the spectral sub-band excluding any additional code bits and the number of frequency bins in the spectral sub-band.

The means for grouping the spectral sub-bands into regions may comprise: means for determining a cost function for each region for all possible combinations of spectral sub-bands; means for combining the cost functions for each region into a set of overall cost functions for all possible combinations of spectral sub-bands; and means for selecting the combination of spectral sub-bands having the lowest overall cost function.

The cost function for each region may be based on at least one of: the maximum number of additional code bits required by any spectral sub-band in the region multiplied by the number of frequency bins in the region requiring additional code bits; and the maximum number of code bits required by any spectral sub-band in the region multiplied by the total number of frequency bins in the region. The cost function may comprise one of the above two factors or a combination of the two factors. Where the cost function comprises a combination, this combination may comprise a sum.

The methods described herein may be performed by firmware or software in machine readable form on a tangible storage medium. The software can be suitable for execution on a parallel processor or a serial processor such that the method steps may be carried out in any suitable order, or simultaneously.

A fourth aspect provides a computer program arranged to perform any of the methods described herein. The computer program may be stored on a tangible machine readable medium.

This acknowledges that firmware and software can be valuable, separately tradable commodities. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

The preferred features may be combined as appropriate, as would be apparent to a skilled person, and may be combined with any of the aspects of the invention.

BRIEF DESCRIPTION OF THE DRAWINGS

Embodiments of the invention will be described, by way of example, with reference to the following drawings, in which.

Figure 1:
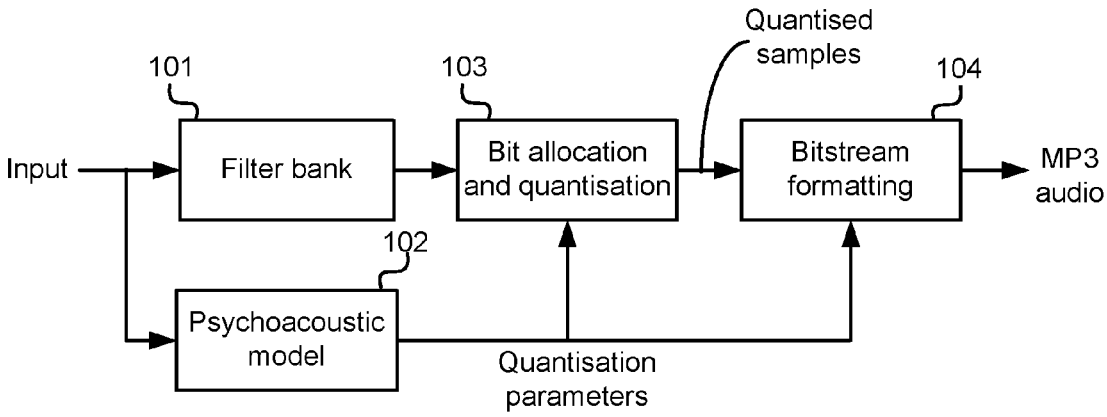
FIG. 1 is a schematic diagram of an MP3 encoder.

Common reference numerals are used throughout the figures to indicate similar features.

DETAILED DESCRIPTION

Embodiments of the present invention are described below by way of example only. These examples represent the best ways of putting the invention into practice that are currently known to the Applicant although they are not the only ways in which this could be achieved. The description sets forth the functions of the example and the sequence of steps for constructing and operating the example. However, the same or equivalent functions and sequences may be accomplished by different examples.

FIG. 1 shows a schematic diagram of an MP3 encoder in which the input passes substantially simultaneously through a filter bank 101 and the psychoacoustic model 102. The psychoacoustic model 102 outputs a set of parameters including the quantisation levels used in quantisation and bit allocation (element 103), which outputs quantised samples. These quantised samples are then input to the bitstream formatting element 104 where they are formatted, for example by being coded using Huffman tables. The use of a psychoacoustic model enables the encoder to achieve high levels of compression without impacting the perceived signal quality. In performing such compression, the signal frames are iteratively encoded (e.g. through adjusting the quantisation step size) and the resultant bitrate determined until the target bitrate is achieved.

It will be appreciated that FIG. 1 shows the functional elements within an example MP3 encoder and there may be additional or fewer elements. Furthermore the elements may be combined in different ways without losing the overall effect and they may all be implemented, for example, within a single chip.

As the statistics of an audio/video signal varies across frequency, it is often beneficial to divide the spectrum into several regions and encode each region separately (e.g. within the bitstream formatting element 104). Dividing the Big Values region into a number of regions (e.g. up to three regions in MP3) in a fixed manner based on the size of Big Values provides a quick method of spectral partitioning which does not require much processing power. However, because each of the regions is encoded using a single code table (e.g. a single Huffman table for MP3) this may result in inefficient encoding.

Ideally the Big Values region should be divided into regions where the spectral values in each region have similar statistics, such that each region contains sub-bands of similar characteristics (e.g. similar ranges of values in the frequency bins). This enables a region to be encoded with a lower bitrate and/or at higher quality. The optimum solution therefore involves considering every possible combination of number of sub-bands in each region and obtaining the actual number of bits for each combination. In order to obtain the actual number of bits for a partitioned spectrum, the spectral values of each region are encoded using all possible code tables and then the best table is selected. This is repeated for each of the regions and the spectral partitioning is typically performed for each granule. This is a lengthy, processor intensive process and is therefore impractical for many applications, particularly for low-power and/or real-time applications.

A code table, which may be used to encode a signal, may include codes for the most common sample values and the coding scheme may in addition provide an escape code in order to facilitate coding of less frequent values which are not included within the table. In such a coding scheme, values within the table may be encoded as the code given in the table and the encoded value may also include a sign bit indicating if the value is positive or negative, as follows:

Code+Sign bit

The bits within the 'code' above are referred to herein as 'code bits'. Where the value is not in the table the value may be encoded using the escape code plus an additional code which identifies the actual value as follows:

Escape code+Additional code+Sign bit

The additional code may have a fixed number of bits (e.g. five bits) and because of the fixed number of bits, the additional code may be referred to as a Pulse Code Modulation (PCM) code. These bits within the additional code are referred to herein as 'additional code bits'. When the bitstream is decoded and an escape code is observed, this fixed number of bits read after the escape pattern will contain the difference between the escape value, which is the first value which cannot be encoded using a code in the table, and the value of the sample to be encoded. In an example, if a coding table includes codes for values up to 14, the escape value is 15. If a value of 35 is to be encoded, the additional code will give the value 20 (i.e. 35−15).

Such a coding scheme may be explained with reference to the following example which uses an additional code length of 5 bits:

| Value | Code |
|---|---|
| 0 | 0 |
| 1 | 10 |
| 2 | 110 |
| Escape | 111 |

Using this coding scheme values between −34 and 34 may be encoded. If the value is 0 only 0 is transmitted and if the value is 1 or 2 the corresponding code is transmitted followed by a sign bit (e.g. zero) to determine that they are positive values. If the value is 3 or more the escape code (111) is transmitted followed by 5 bits giving the difference between the value and 3 (i.e. the escape value). Negative values are transmitted in the same manner but with a one as their sign bit. The following table provides some examples of coded values:

| Value | Code Transmitted |
|---|---|
| 0 | 0 = Code |
| 1 | 100 = Code + Sign Bit |
| 4 | 111000010 = Escape Code + Additional Code + Sign bit |
| 3 | 111000000 = Escape Code + Additional Code + Sign bit |
| −3 | 111000001 = Escape Code + Additional Code + Sign bit |
| 34 | 111111110 = Escape Code + Additional Code + Sign bit |

As shown by the examples in the table above, whilst use of escape codes and additional codes enables values outside the range of the code table to be encoded, their use results in an encoding overhead of the escape code, plus the fixed number of bits of the additional code. In order to improve the efficiency of encoding, the requirement to use escape codes and additional codes should be minimised.

For MP3 applications, Huffman coding is used and in Huffman encoding, the code bits are referred to as 'Huffman bits' and the additional code bits are referred to as 'linbits'. There are 30 different Huffman tables which may be used and each code in a Huffman table determines two values. The code also indicates whether either or both of the two values are also using linbits or not. Escape codes, and therefore linbits, are only provided by some of the 30 Huffman tables and the number of these bits (if they exist) is determined by the table index which is also transmitted.

The methods described herein may be applied to quantised MDCT (modified discrete cosine transform) values. In other examples, other frequency analysis methods (other than MDCT) may be used, such as FFT (fast Fourier transform).

MP3 coding, and its terminology (e.g. linbits) is used by way of example only in the following description of various methods of spectral partitioning and the techniques described are applicable to other coding schemes, such as variable run-length (VRL) code, which may be used in image/video coding.

Figure 2:
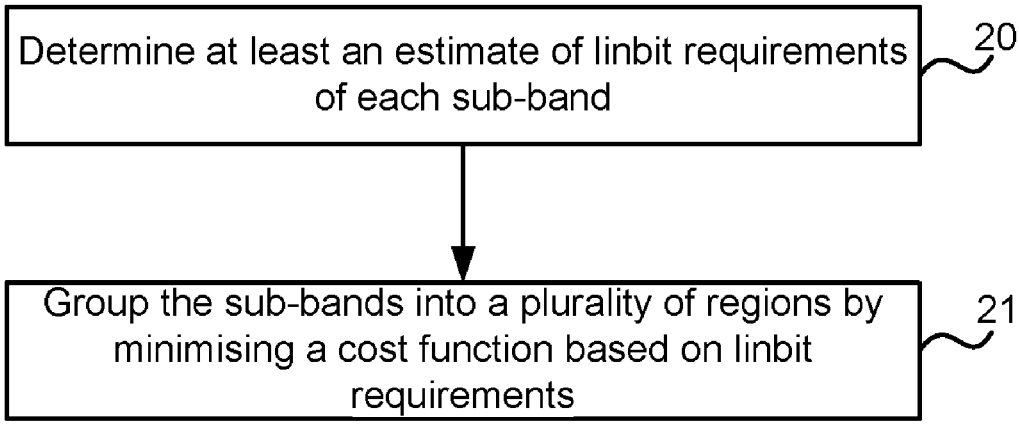
FIG. 2 is a flow diagram of an example method of spectral partitioning.

FIG. 2 is a flow diagram of an example method of spectral partitioning which requires significantly less computation than the optimum solution (described above) whilst achieving similar (near-perfect) coding efficiency. According to this method, an estimate of linbit requirements of each sub-band is determined (block 20) and then different combinations of the number of sub-bands in each region are searched and the combination which results in the lowest cost is selected as the partitioning solution (block 21). The cost is defined in terms of at least the measure of linbit requirements (as determined in block 20). These steps are described in detail below. For some sub-bands, the estimate of linbit requirements may be zero (i.e. where no linbits are required), as described below.

Having performed the spectral partitioning, the optimum code table (e.g. Huffman table) can be selected for each region. The table may be selected base on factors including the maximum amplitude in a region. Of the 30 Huffman tables, there are typically two or three that could be used for a region based on a particular maximum amplitude in that region.

This method takes into consideration the characteristics of a particular signal (e.g. the abstract statistics of spectral sub-bands), which may be an audio signal, which is being encoded into an MP3 stream. The estimate of linbit requirements is a parameter which can be easily extracted from each of the sub-bands and in some circumstances some or all of the data may already be available within an encoder from an earlier stage in the encoding process.

Figure 3:
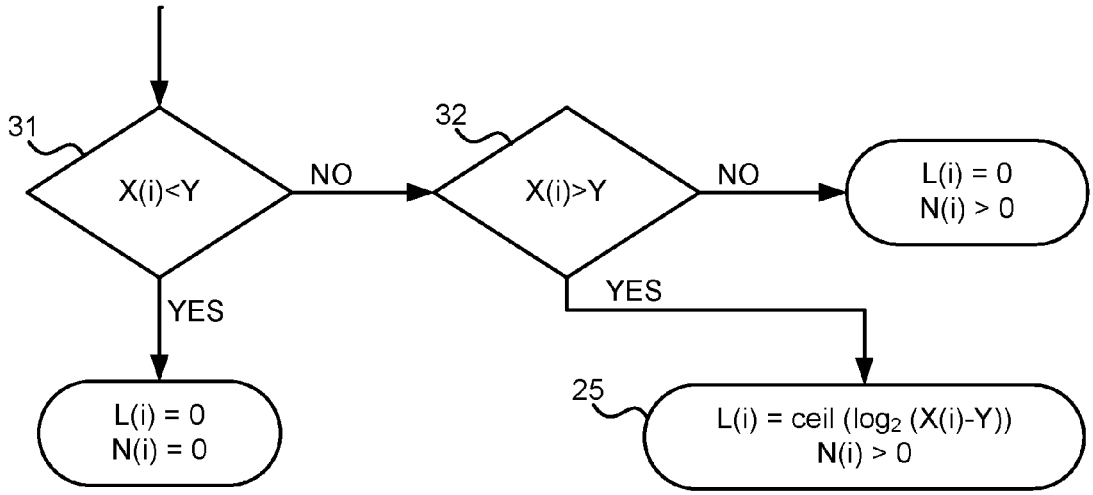
FIG. 3 shows a flow chart of an example method of determining the number of frequency bins in a sub-band and the maximum number of additional bits (linbits) required to encode the maximum value in a sub-band.

In a first example implementation, the estimate of linbit requirements for a sub-band i may comprise two parameters: N(i), the number of frequency bins (or samples) in the sub-band i that need linbits and L(i), the maximum number of linbits required to encode the maximum value in the sub-band. FIG. 3 shows a flow chart of an example method of determining the values of N(i) and L(i) which can be described with reference to FIG. 4 which shows an example set of frequency bins divided into two sub-bands, i=1 and i=2, where i is the sub-band index and each of these sub-bands comprises 4 frequency bins (0-3 and 4-7). The absolute maximum value in any of the frequency bins in a particular sub-band i is denoted by X(i) and in the example of FIG. 4, X(1)=30 and X(2)=10.

Whether linbits are required is determined by the maximum value which can be encoded without using linbits, Y−1, where Y is the escape value. For MP3 the escape value is defined as 15 (i.e. Y=15, therefore Y−1=14) but for other applications, the escape value may have a different value. Any value equal to or exceeding Y (i.e. ≧15 for MP3) requires linbits. The threshold (or escape value) Y is indicated by a dotted line in FIG. 4.

Figure 4:
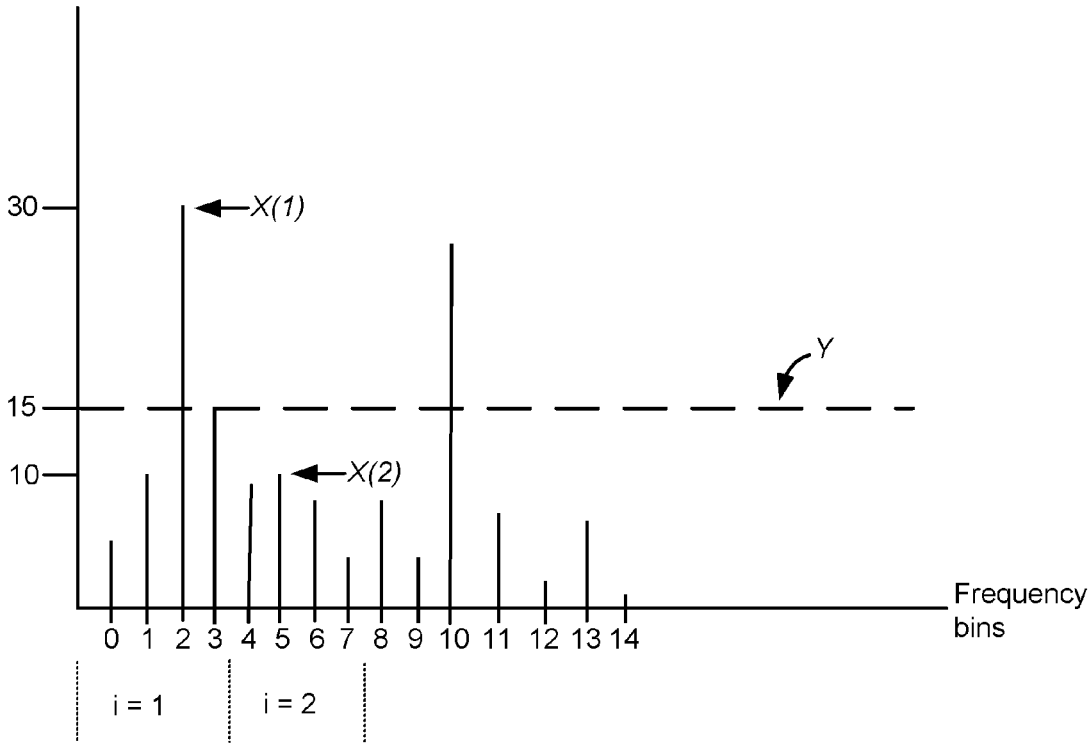
FIG. 4 is a schematic diagram showing an example set of frequency bins divided into two sub-bands.

If none of the values in any of the frequency bins in a sub-band equals or exceeds the threshold Y, ('Yes' in block 31), as in sub-band 2 of FIG. 4, there are no samples which require linbits in that sub-band (N(i)=0) and the number of linbits required is zero (L(i)=0).

If the maximum value in any of the frequency bins within a sub-band exceeds or equals the threshold, X(i)≧Y, ('No' in block 31), then there will be some samples which require linbits (N(i)>0). The number of samples requiring linbits, N(i), is the number of frequency bins with a value which exceeds or equals the threshold. In the example of FIG. 4, sub-band 1 has two samples which require linbits (frequency bins 2 and 3), i.e. N(1)=2.

If X(i)=Y, ('No' in both blocks 31 and 32) the linbit size is zero, i.e. L(i)=0. However, where X(i)>Y, ('No' in block 31 and 'Yes' in block 32), the maximum number of linbits required, L(i), may be computed as follows:

$$L(i)=\text{ceil}(\log_2(X(i)-Y))$$

where: cell is a function which rounds up to the nearest integer (also known as 'CEILING' function).

The flow chart of FIG. 3 demonstrates that it may not be necessary to calculate N(i) and L(i) for all sub-bands. The values may in some circumstances be the consequence of the value of X(i), which may already be known from the previous stages and hence may not need to be calculated.

Figure 5:
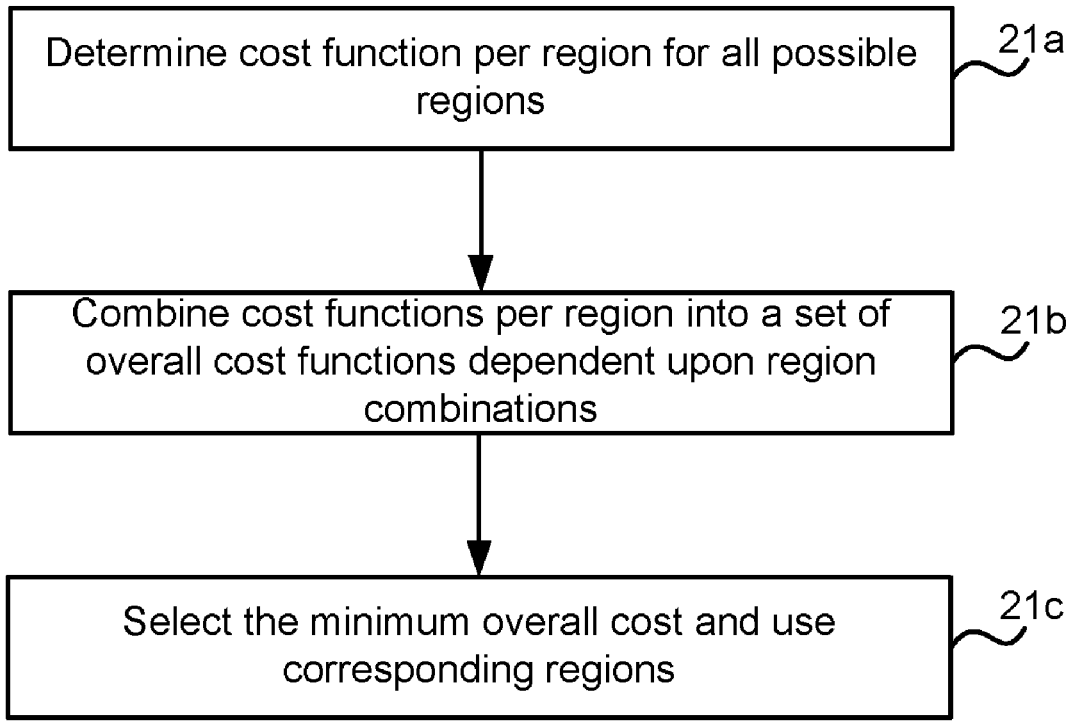
FIG. 5 is a flow diagram showing one of the steps of FIG. 2 in more detail.

These parameters N(i) and L(i) may then be used in a cost function in order to group the sub-bands into regions (in block 21, as shown in more detail in FIG. 5). The cost function, B(j,k) for a single region starting from sub-band j and finishing at sub-band k can be defined as the maximum number of linbits required by any of the sub-bands within the region ($L_{MAX}$) multiplied by the number of samples in the region which require linbits, which can be written as:

$$B(j,k)=L_{MAX}(j,k)\sum_{i=j}^{k}N(i)$$

where: $L_{MAX}(j,k)=\max\{L(i)\}$ for i=j . . . k

Using this cost function per region B(j,k) for all possible regions (determined in block 21*a*), i.e. where j,k can be varied to cover all possible sub-band combinations, the overall cost function for each possible region combination can be calculated as the sum of the cost functions for each individual region, i.e. for one possible region combination:

$$B_{overall}=B(1,r_1)+B(r_1+1,r_2)+\ldots+B(r_{n-1},K)$$

where there are K sub-bands being grouped into n regions and the values $r_x$ determine which sub-bands are included within each region. By iterating through the possible values of $r_x$:

$$r_1=1\ \ldots\ (K-n+1)$$

$$r_2=(r_1+1)\ \ldots\ (K-n+2)$$

$$\ldots$$

$$r_{n-1}=(r_{n-2}+1)\ \ldots\ (K-1)$$

the overall cost functions for each possible region combination can be computed (block 21*b*) and the region combination with the minimum overall cost function selected (block 21*c*). As a result the spectrum is partitioned into the regions according to the combination with the minimum overall cost function. Having performed the spectral partitioning in this way, the optimum code table (e.g. Huffman code) can be selected for each region.

Typically for MP3, there are 22 sub-bands (K=22) being divided into three regions (n=3) and as described above there is a limit on the maximum size of each of the first and second regions. In such an example:

$$B_{overall}=B(1,r_1)+B(r_1+1,r_2)+B(r_2+1,22)$$

where the values of $r_1,r_2,r_3$ are iterated through all combinations of the following values:

$$r_1=1\ \ldots\ 16$$

$$r_2=r_1+1\ \ldots\ \min(r_1+8,21)$$

$$r_3=r_2+1\ \ldots\ 22$$

There are many other estimates of bit requirements of each sub-band which may be used instead of, or in combination with, the estimate and/or parameters described above and some of the options are described in more detail below.

Figure 6:
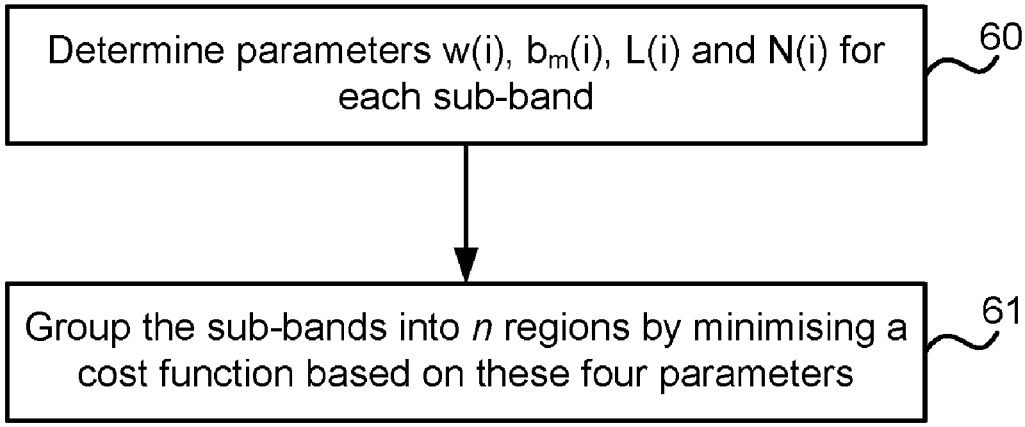
FIG. 6 is a flow diagram of an example method of spectral partitioning which uses an estimation of the Huffman bit requirements and, where linbits are required, an estimation of the linbit requirements.

In a second example implementation, the cost function may be based on an estimate of Huffman bit requirements and, where linbits are required, also on an estimate of linbit requirements (which may for example be determined as described above). FIG. 6 is a flow diagram of such an example method. Analysis of the Huffman bit requirements enables the grouping of sub-bands based on their characteristics even where none of the values in the frequency bins are sufficiently large to require linbits.

Initially four parameters are determined for each of the sub-bands (block 61):

- N(i)=the number of frequency bins that need linbits in sub-band i
- L(i)=the maximum number of linbits required to encode the maximum value in sub-band i
- w(i)=the number of frequency bins (or samples) in the sub-band
- $b_M(i)$=the number of bits used for encoding the maximum value excluding its linbits In some cases, the values of one or more of the parameters may be fixed. For example, for MP3 encoding, the number of frequency bins in a sub-band is fixed on a granule to granule basis and only varies with sample rate. As a result, the value of w(i) will generally be the same for the entirety of an audio file. In the example shown in FIG. 4, w(1)=4 and w(2)=4. Additionally it may not be necessary to compute some of the parameters because they may already be known from earlier or other parts of the encoder (e.g. some parameters may have been determined in the psychoacoustic model). Furthermore, it may not be necessary to calculate all the parameters as some may be a direct consequence of others, as described below.

Figure 7:
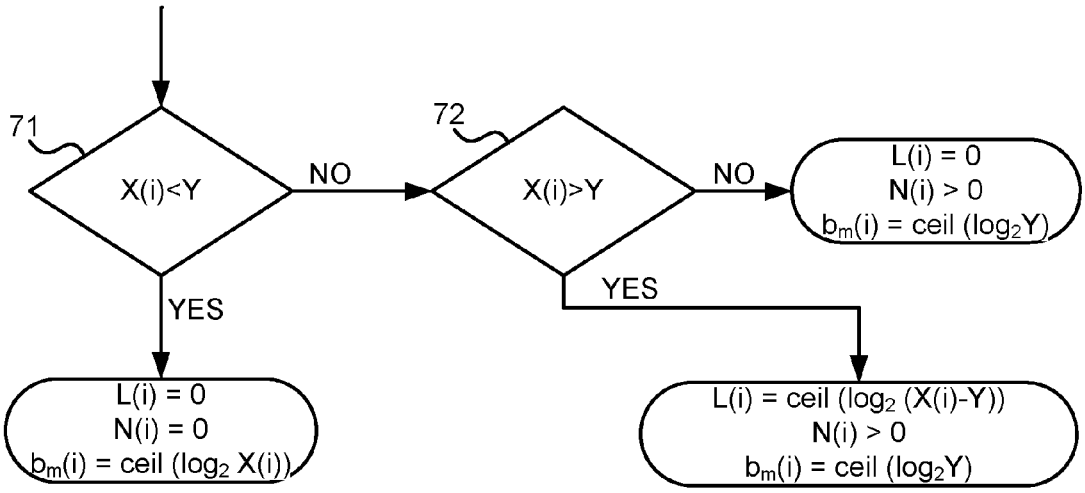
FIG. 7 shows a flow chart of an example method of determining the values of parameters N(i), L(i) and $b_M$(i) which is an extension of that shown in FIG. 3.

FIG. 7 shows a flow chart of an example method of determining the values of parameters N(i), L(i) and $b_M(i)$ which is an extension of that shown in FIG. 3 and described above. As detailed above, the absolute maximum value in any of the frequency bins in a particular sub-band i is denoted by X(i). If X(i)<Y('Yes' in block 71), then:

$$b_M(i)=\text{ceil}(\log_2 X(i))$$

However, if X(i)≧Y ('No' in block 71 and 'Yes' or 'No' in block 72), then the number of bits used for encoding the maximum value excluding its linbits is a constant value given by:

$$b_M(i)=\text{ceil}(\log_2 Y)$$

In MP3 applications, for example, Y=15, and therefore if X(i)≧Y then:

$$b_M(i)=4$$

In the example shown in FIG. 4:

$$N(1)=2$$

$$L(1)=\text{ceil}(\log_2(30-15))=4$$

$w(1)=4$ $b_M(1)=\text{ceil}(\log_2 15)=4$ $N(2)=0$ $L(2)=0$ $w(2)=4$ $b_M(2)=\text{ceil}(\log_2 10)=4$ The four parameters (determined in block 60) may then be used to form a per-region cost function which is a combination (e.g. the sum) of an estimated number of Huffman bits required and an estimated number of linbits required (if any). The linbits term may be as described above, i.e.:

$$\text{Estimated linbits} = L_{MAX}(j,k)\sum_{i=j}^{k} N(i)$$

or alternatively any other measure of the number of linbits required may be used.

The Huffman bits estimate may be determined from the number of bits required to encode the largest value for any of the frequency bins in the region excluding its linbits ($b_{MAX}$) multiplied by the sum of the number of frequency bins (or samples) in each sub-band in the region. This term may be written as:

$$\text{Estimated Huffman bits} = b_{MAX}(j,k)\sum_{i=j}^{k} w(i)$$

where: $b_{MAX}(j,k)=\max\{b_M(i)\}$ for $i=j \ldots k$

The cost function, B(j,k) for a single region starting from sub-band j and finishing at sub-band k can therefore be written as the sum of these two terms:

$$B(j,k) = b_{MAX}(j,k)\sum_{i=j}^{k} w(i) + L_{MAX}(j,k)\sum_{i=j}^{k} N(i)$$

where: $L_{MAX}(j,k)=\max\{L(i)\}$ for $i=j \ldots k$ and $b_{MAX}(j,k)=\max\{b_M(i)\}$ for $i=j \ldots k$ Using the example of FIG. 4:

$$\begin{aligned} B(1,2) &= b_{MAX}(1,2)\sum_{i=1}^{2} w(i) + L_{MAX}(1,2)\sum_{i=1}^{2} N(i) \\ &= (4\times(4+4)) + (4\times(2+0)) \\ &= 40 \end{aligned}$$

Using the cost function per region B(j,k) detailed above for all possible regions, i.e. where j,k are varied to cover all possible sub-band combinations, the overall cost function for each possible region combination can be calculated (as above) as the sum of the cost functions for each individual region, i.e. for one possible region combination:

$$B_{overall}=B(1,r_1)+B(r_1+1,r_2)+\ldots+B(r_{n-1},K)$$

where there are K sub-bands being grouped into n regions and the values $r_x$ determine which sub-bands are included within each region. By iterating through the possible values of $r_x$:

$$\begin{aligned} r_1 &= 1 \ldots (K-n+1) \\ r_2 &= (r_1+1) \ldots (K-n+2) \\ &\ldots \\ r_{n-1} &= (r_{n-2}+1) \ldots (K-1) \end{aligned}$$

the overall cost functions for each possible region combination can be computed and the region combination with the minimum overall cost function selected (block 61):

$$\vec{r} = \underset{r_1 \ldots r_{n-1}}{\operatorname{argmin}}\{B(1,r_1)+B(r_1+1,r_2)+\ldots+B(r_{n-1},K)\}$$

where $r_x$ is the index of the last sub-band in region x and $\vec{r}$ is the vector containing the resultant boundaries of each region. The first region (x=1) starts at sub-band 1 and the last region (x=K) ends at sub-band K. Results achieved using this method and this particular cost function are described below.

Whilst this second example implementation uses a combination of an estimate of the Huffman bit requirements and, where linbits are required, an estimate of the linbit requirements, in a further implementation, only an estimate of the Huffman bit requirements (i.e. the code bit requirements) may be used.

Using the methods described above, the minimum size of any region is one sub-band, although there may be constraints dependent upon the particular application which restrict region size further, e.g. for MP3 there are only a small number bits available to communicate the sizes of the first and second regions and this therefore puts a limit on the maximum size of these regions. As the third region comprises all the remaining sub-bands, the MP3 specification comprises no such maximum size limit on the third region.

In a further example implementation, the maximum number of linbits required by any of the sub-bands within the region ($L_{MAX}$) may be used as the cost function, such that:

$$B(j,k)=L_{MAX}(j,k)$$

where: $L_{MAX}(j,k)=\max\{L(i)\}$ for $i=j \ldots k$

In another implementation, the cost function may also include the number of bits required to encode the largest value for any of the frequency bins in the region ($b_{MAX}$), such that the cost function comprises:

$$B(j,k)=b_{MAX}(j,k)+L_{MAX}(j,k)$$

where: $L_{MAX}(j,k)=\max\{L(i)\}$ for $i=j \ldots k$ and $b_{MAX}(j,k)=\max\{b_M(i)\}$ for $i=j \ldots k$ In another example implementation, the estimate of linbit requirements may use an average number of linbits required or fixed value instead of the maximum number of linbits required, L(i). In such an example the cost per region may be:

$$B(j,k) = L\sum_{i=j}^{k} N(i)$$

where L is a predefined parameter (e.g. a constant). This value L may be considered to be a per frequency bin penalty for use of linbits. In a further example this estimation of linbit requirements may be combined with a term for the Huffman bits (e.g. as described above with reference to FIG. 6), giving:

$$B(j,k) = b_{MAX}(j,k)\sum_{i=j}^{k} w(i) + L\sum_{i=j}^{k} N(i)$$

In a further variation, the value $b_{MAX}(j,k)$ may be replaced by a constant value $b_{const}$ giving:

$$B(j,k) = b_{const}\sum_{i=j}^{k} w(i) + L\sum_{i=j}^{k} N(i)$$

In an example, $b_{const}$ may be set equal to ceil($\log_2$ Y) although in such a situation the benefit of using the Huffman bit estimate term within the cost function may be limited given that w(i) is generally fixed. This may however be beneficial where a number of sub-bands are eliminated, for example because the audio in those sub-bands is completely masked.

In a further example implementation, the estimate of linbit requirements may be a determination of whether the sub-band uses linbits or not. In the example shown in FIG. 4, the first sub-band requires linbits as there are two values which equal or exceed 15 (frequency bins 2 and 3) whilst the second sub-band does not require linbits as there are no values which equal or exceed 15. In such an example, a parameter equal to one may indicate that linbits are required, whilst a parameter equal to zero may indicate that linbits are not required, such that:

Linbits($i$)=parameter of linbit requirements of sub-band $i$

Linbits(1)=1

Linbits(2)=0

In this example, the cost function B(j,k) for a region starting from sub-band j and finishing at sub-band k may comprise:

$$B(j,k) = a\sum_{i=j}^{i=k} \text{Linbits}(i)$$

where a is a predefined parameter (e.g. a constant). This value, a, may be considered to be a per sub-band penalty for use of linbits.

In a further example implementation, the estimate of bit requirements may comprise an estimated average code length per frequency bin, e.g. an estimate of the required Huffman bits and any required linbits.

The spectral partitioning may be performed for an entire file or data group or alternatively may be performed for each portion of the file or data group. In the example of MP3 encoding, the spectral partitioning may be performed on a per-granule basis.

Whilst in MP3 applications, the search (in block 21 or 61) can be performed over the entire search space, in other applications the search space may be too large (e.g. because n and/or K are large). In some applications it may be beneficial to initially perform a coarser search (in block 21 or 61), e.g. using a coarser combination of sub-bands, to determine a trend and thereby seek a solution. In an example, the values $r_x$ may initially be iterated in steps of two or five, with the search being narrowed down such that values of $r_x$ need only be iterated in steps of one over a smaller search region. In another example, the partitioning obtained for the previous frame may be used as an initial partitioning with only a limited amount of deviation from those values being allowed in order to reduce the computational complexity.

Many of the calculations in the methods described above involve the calculation of a logarithm to the base 2. Such computations may be implemented within a DSP (digital signal processor) using an instruction which is designed to detect the number of sign bits of a number (e.g. for use in normalisation of a number or in fixed-point to floating-point conversion). The number of sign bits of a number may be defined as the number of positions by which the number is shifted in normalisation (this can alternatively be considered to be the number of positions by which the decimal position is moved) or the exponent of a normalised floating-point number. Examples of such an instruction include 'SIGNDET' (as used by CSR plc), 'EXP' (as used by Analog Devices) and 'NORM' (as used by Texas Instruments). Such an instruction returns (using the SIGNDET instruction name by way of example only):

$$y=\text{SIGNDET}(x)=z-\lfloor \log_2(|x+0.5|)\rfloor-2$$

where z is the precision of the processor and $\lfloor\ \rfloor$ rounds towards minus infinity.

Using such an instruction, the estimation of parameters L(i) and $b_M(i)$ can be approximately implemented on a DSP as:

$$L(i)=a-\text{SIGNDET}(X(i)-Y)$$

$$b_M(i)=b-\text{SIGNDET}(X(i)) \text{ where } X(i)<Y$$

$$b_M(i)=b-\text{SIGNDET}(Y) \text{ where } X(i)\geqq Y$$

where a and b are predefined parameters (e.g. constants). Whilst the instruction 'SIGNDET' (and its equivalents used by other DSP manufacturers) itself is known, it was intended for use in normalisation of numbers and this is a new application and use for the instruction.

The methods described above achieve near-perfect partitioning of the spectrum with many fewer MIPS than the optimum solution. Use of these methods results in saving about 5% in the resulting bitrate when compared to alternative algorithms. The table below shows some results achieved from use of the following cost function:

$$B(j,k) = b_{MAX}(j,k)\sum_{i=j}^{k} w(i) + L_{MAX}(j,k)\sum_{i=j}^{k} N(i)$$

where: $L_{MAX}(j,k)=\max\{L(i)\}$ for i=j . . . k and $b_{MAX}(j,k)=\max\{b_M(i)\}$ for i=j . . . k The method was tested on 13,511 MP3 frames (approximately 5 minutes and 53 seconds) where each frame consisted of four granules and each granule was sub-divided into three regions (n=3, K=22). The nominal bitrate was 160 kbps.

| | |
|---|---|
| Bitrate increase when the methods described herein were used instead of the optimum solution | 0.57% |

-continued

| | |
|---|---|
| Bitrate increase when table look-up was used instead of the optimum solution (LAME 3.97) | 5.26% |
| Computational complexity of the methods described herein | 0.62 MIPS* |
| Computational complexity of the optimum solution | 26.8 MIPS |
| Computational complexity of a table look-up approach | 0.31 MIPS* |

*as the optimum solution includes the selection of the optimum Huffman table, an additional 0.3 MIPS have been included within the results for the methods described herein and the table look-up approach in order to provide a true comparison.

These results show that the increase in bitrate using the proposed methods is small in comparison to the optimum solution. This small increase in bitrate is achieved at the same time as improving the speed by more than 43 times. In fact, as an encoder may use as little as 30 MIPS (or lower), the large overhead of the optimum solution makes it unfeasible in most applications. In comparison to the table look-up approach, the increase in bitrate is much smaller, because the table look-up approach encodes redundancies in the signal.

Whilst the MP3 specification limits the number of regions to three and provides restrictions on the number of sub-bands which may be in each of the first two regions, the method may also be applied where such limitations and restrictions do not apply. The methods may be applied to encoding of audio signals (e.g. using MP3 or AAC (Advanced Audio Coding)), video signals or other signal types (e.g. multimedia signals).

Whilst the above examples relate to MP3 audio encoding in which the sub-band boundaries are defined in the specification, this is by way of example only. The methods described herein may be applied to any type of signal and any encoding technology (e.g. AAC) and the sub-bands may match any perceptually meaningful division of frequency.

Furthermore, whilst the methods described herein may be used for spectral partitioning of the Big Values region for MP3 applications where the resultant regions are to be coded using one Huffman table per region, the methods are more broadly applicable. The techniques described may be used to partition a spectrum into regions with similar statistics and this partitioning may then be used in any manner and for any application. For example, the spectrum may be partitioned for other types of processing/analysis, such as speech recognition. The methods described above are not limited to MP3 encoding or to spectral partitioning for the purposes of encoding.

Any range or device value given herein may be extended or altered without losing the effect sought, as will be apparent to the skilled person.

It will be understood that the benefits and advantages described above may relate to one embodiment or may relate to several embodiments. It will further be understood that reference to an item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

It will be understood that the above description of a preferred embodiment is given by way of example only and that various modifications may be made by those skilled in the art.

The invention claimed is:

1. A method of spectral partitioning for use in encoding a signal comprising:

determining, on a processor, an estimate of bit requirements for each of a plurality of spectral sub-bands of the signal, wherein the estimate of bit requirements comprises an estimate of code bit requirements and an estimate of additional code bit requirements;

grouping, on a processor, the spectral sub-bands of the signal into a plurality of regions by minimising a cost function based on the estimates of bit requirements for each of the spectral sub-bands, wherein a cost function B(j,k) for a single region starting from sub-band j and finishing at sub-band k is given by:

$$B(j,k) = b_{MAX}(j,k)\sum_{i=j}^{k} w(i) + L_{MAX}(j,k)\sum_{i=j}^{k} N(i)$$

where $b_{MAX}(j,k)=\max\{b_M(i)\}$ for i=j . . . k, with $b_M(i)$=a number of bits used for encoding a maximum value in sub-band i excluding its linbits, $L_{MAX}(j,k)=\max\{L(i)\}$ for i=j . . . k, with L(i)=a maximum number of linbits required to encode the maximum value, w(i) is a number of frequency bins in the sub-band, and N(i) is a number of samples in the sub-band i that need linbits;

computing an overall cost function for each possible region combination; and selecting the combination of spectral sub bands having the lowest overall cost function;

wherein computing the overall cost function for each possible region comprises:

combining the cost functions for each region into a set of overall cost functions for all possible combinations of spectral sub-bands, wherein the overall cost function for each possible region combination can be calculated as the sum of the cost functions for each individual region $B_{overall}=B(1,r_1)+B(r_1+1,r_2)+\ldots+B(r_{n-1},K)$ where there are K sub-bands being grouped into n regions and the values $r_x$ determine which sub-bands are included within each region; and iterating through possible values of $r_x$.

2. The method according to claim 1, wherein the estimate of code bit requirements comprises an estimate of bit requirements when encoded using a Huffman tree and the estimate of additional code bit requirements comprises an estimate of bit requirements for encoding values not presented in a Huffman table.

3. The method according to claim 1, further comprising:

selecting a code table for each of the regions; and encoding each region using the selected code table for that region.

4. The method according to claim 3, wherein each code table comprises a Huffman table.

5. The method according to claim 4, wherein the signal comprises an audio signal.

6. An encoder comprising:

a determining element arranged to determine at least an estimate of bit requirements for each of a plurality of spectral sub-bands, wherein the estimate of bit requirements comprises an estimate of code bit requirements and an estimate of additional code bit requirements, and a grouping element arranged to group the spectral sub-bands into a plurality of regions by minimising a cost function based on the estimates of bit requirements for each of the spectral sub-bands wherein the grouping element comprises:

a costing element arranged to determine a cost function for each region for all possible combinations of spectral sub-bands, wherein the cost function B(j,k) for a single region starting from sub-band j and finishing at sub-band k is given by:

$$B(j,k) = b_{MAX}(j,k)\sum_{i=j}^{k} w(i) + L_{MAX}(j,k)\sum_{i=j}^{k} N(i)$$

where $b_{MAX}(j,k)=\max\{b_M(i)\}$ for i=j . . . k, with $b_M(i)$=a number of bits used for encoding a maximum value in sub-band i excluding its linbits, $L_{MAX}(j,k)=\max\{L(i)\}$ for i=j . . . k, with L(i)=a maximum number of linbits required to encode the maximum value, w(i) is a number of frequency bins in the sub-band, and N(i) is a number of samples in the sub-band i that need linbits;

a combining element arranged to combine the cost functions for each region into a set of overall cost functions for all possible combinations of spectral sub-bands wherein the overall cost function for each possible region combination can be calculated as the sum of the cost functions for each individual region $B_{overall}=B(1,r_1)+B(r_1+1,r_2)+ \ldots +B(r_{n-1},K)$ where there are K sub-bands being grouped into n regions and the values $r_x$ determine which sub-bands are included within each region; and compute the overall cost function for each possible region combination by iterating through possible values of $r_x$: and a selecting element arranged to select the combination of spectral sub-bands having the lowest overall cost function.

7. A method of encoding an audio signal comprising, at a processor:

determining, an estimate of bit requirements for each of a plurality of spectral sub-bands of the audio signal, wherein the estimate of bit requirements comprises an estimate of code bit requirements and an estimate of additional code bit requirements;

grouping, the spectral sub-bands of the signal into a plurality of regions by minimising a cost function based on the estimates of bit requirements for each of the spectral sub-bands, wherein the cost function B(j,k) for a single region starting from sub-band j and finishing at sub-band k is given by:

$$B(j,k) = b_{MAX}(j,k)\sum_{i=j}^{k} w(i) + L_{MAX}(j,k)\sum_{i=j}^{k} N(i)$$

where $b_{MAX}(j,k)=\max\{b_M(i)\}$ for i=j . . . k, with $b_M(i)$=a number of bits used for encoding a maximum value in sub-band i excluding its linbits, $L_{MAX}(j,k)=\max\{L(i)\}$ for i=j . . . k, with L(i)=a maximum number of linbits required to encode the maximum value, w(i) is a number of frequency bins in the sub-band, and N(i) is a number of samples in the sub-band i that need linbits;

computing an overall cost function for each possible region, wherein computing the overall cost function for each possible region comprises; combining the cost functions for each region into a set of overall cost functions for all possible combinations of spectral sub-bands, wherein the overall cost function for each possible region combination can be calculated as the sum of the cost functions for each individual region $B_{overall}=B(1,r_1)+B(r_1+1,r_2)+ \ldots +B(r_{n-1},K)$ where there are K sub-bands being grouped into n regions and the values $r_x$ determine which sub-bands are included within each region and; iterating through possible values of $r_x$; and selecting the combination of spectral sub-bands having the lowest overall cost function;

selecting a code table for each of the regions; and encoding each region using the selected code table for that region.

* * * * *

UNITED STATES PATENT AND TRADEMARK OFFICE

CERTIFICATE OF CORRECTION

PATENT NO. : 8,332,217 B2
APPLICATION NO. : 12/679724
DATED : December 11, 2012
INVENTOR(S) : Hargreaves et al.

It is certified that error appears in the above-identified patent and that said Letters Patent is hereby corrected as shown below:

In Column 6, Line 26, delete "base" and insert -- based --, therefor.

In Column 13, Line 50, delete "an" and insert -- 'an' --, therefor.

In Column 15, Line 28, in Claim 6, delete "$r_x$:" and insert -- $r_x$; --, therefor.

In Column 16, Line 31, in Claim 7, delete "$r_x$; and" and insert -- $r_x$; --, therefor.

Signed and Sealed this
Nineteenth Day of February, 2013

Teresa Stanek Rea
*Acting Director of the United States Patent and Trademark Office*